US006837050B2

(12) United States Patent
Mandai et al.

(10) Patent No.: US 6,837,050 B2
(45) Date of Patent: Jan. 4, 2005

(54) GAS TURBINE COMBUSTOR

(75) Inventors: Shigemi Mandai, Takasago (JP); Kiyoshi Suenaga, Takasago (JP); Kuniaki Aoyama, Takasago (JP); Kazufumi Ikeda, Takasago (JP); Katsunori Tanaka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 194 days.

(21) Appl. No.: 10/124,413

(22) Filed: Apr. 18, 2002

(65) Prior Publication Data

US 2002/0152751 A1 Oct. 24, 2002

(30) Foreign Application Priority Data

Apr. 19, 2001 (JP) ..... 2001-121498

(51) Int. Cl.[7] ..... F02C 7/25
(52) U.S. Cl. ..... 60/725; 60/757; 60/746
(58) Field of Search ..... 60/725, 757, 39.37, 60/746

(56) References Cited

U.S. PATENT DOCUMENTS 4,389,848 A * 6/1983 Markowski et al. ..... 60/738
5,454,221 A * 10/1995 Loprinzo ..... 60/772
5,685,157 A 11/1997 Pandalai et al.

FOREIGN PATENT DOCUMENTS

| | | |
|---|---|---|
| DE | 196 12 987 | 9/1996 |
| EP | 0 892 216 | 1/1999 |
| EP | 0 900 982 | 3/1999 |
| EP | 1 213 539 | 6/2002 |
| EP | 1 221 574 | 7/2002 |
| GB | 2 309 296 | 7/1997 |
| JP | 2001-254634 | 9/2001 |
| WO | WO 02/25174 | 3/2002 |

* cited by examiner

*Primary Examiner*—Ehud Gartenberg
(74) *Attorney, Agent, or Firm*—Oblon, Spivak, McClelland, Maier & Neustadt, P.C.

(57) ABSTRACT

A gas turbine combustor includes a side wall, for defining a combustion volume, having upstream and downstream ends, a pilot nozzle, disposed adjacent the upstream end of the side wall, for discharging a pilot fuel to form a diffusion flame in the combustion volume, and a plurality of main nozzles, provided around the pilot nozzles, for discharging a fuel-air mixture to form premixed flames in the combustion volume. Film air is supplied into the combustion volume downstream of the main nozzles along the inner surface of the side wall to reduce the fuel-air ratio in a region adjacent the inner surface of the side wall and to restrain a combustion-driven oscillation in the combustion volume.

10 Claims, 7 Drawing Sheets

GAS TURBINE COMBUSTOR

BACKGROUND OF THE INVENTION

1. Field of the Invention

The invention relates to a gas turbine combustor.

2. Description of the Related Art

Conventional gas turbine utilizes a two-stage combustor which includes a pilot nozzle for forming a diffusion flame, as a pilot flame, along the axis of the combustor, and a plurality of main nozzles for discharging a fuel-air mixture to form premixed flames as the main combustion around the diffusion flame.

In the conventional gas turbine combustor, the premixed flames complete the combustion process in a short length in the axial direction of the combustor which may result in short flames or a rapid combustion adjacent a wall. When the combustion process is completed within a small volume, the volumetric density of the energy released by the combustion or the combustion intensity in the combustor becomes high so that a combustion-driven oscillation can easily be generated within a plane perpendicular to the axis or in the peripheral direction. The combustion-driven oscillation is self-excited oscillation generated by the conversion of a portion of the thermal energy to the oscillation energy. The larger the combustion intensity in a section of a combustor, the larger the exciting force of the combustion-driven oscillation to promote the generation of the combustion-driven oscillation.

SUMMARY OF THE INVENTION

The invention is directed to solve the prior art problems, and to provide a gas turbine combustor which is improved to reduce a combustion-driven oscillation.

According to the invention, a gas turbine combustor comprises a side wall for defining a combustion volume, having upstream and downstream ends, a pilot nozzle, disposed adjacent the upstream end of the side wall, for discharging a pilot fuel to form a diffusion flame in the combustion volume, and a plurality of main nozzles, provided around the pilot nozzles, for discharging a fuel-air mixture to form premixed flames in the combustion volume. Film air is supplied into the combustion volume downstream of the main nozzles along the inner surface of the side wall to reduce the fuel-air ratio in a region adjacent the inner surface of the side wall and to restrain a combustion-driven oscillation in the combustion volume.

According to another feature of the invention, a gas turbine combustor comprises a side wall for defining a combustion volume the side wall having upstream and downstream ends, a pilot nozzle, disposed adjacent the upstream end of the side wall, for discharging a pilot fuel to form diffusion flame in the combustion volume, and a plurality of main nozzles, provided around the pilot nozzles, for discharging a fuel-air mixture to form premixed flames in the combustion volume. The side wall includes a plurality of oscillation damping orifices which are defined in a region downstream of the main nozzles and extend radially through the side wall.

DESCRIPTION OF THE DRAWINGS

These and other objects and advantages and further description will now be discussed in connection with the drawings in which.

DESCRIPTION OF THE PREFERRED EMBODIMENTS

Figure 1:
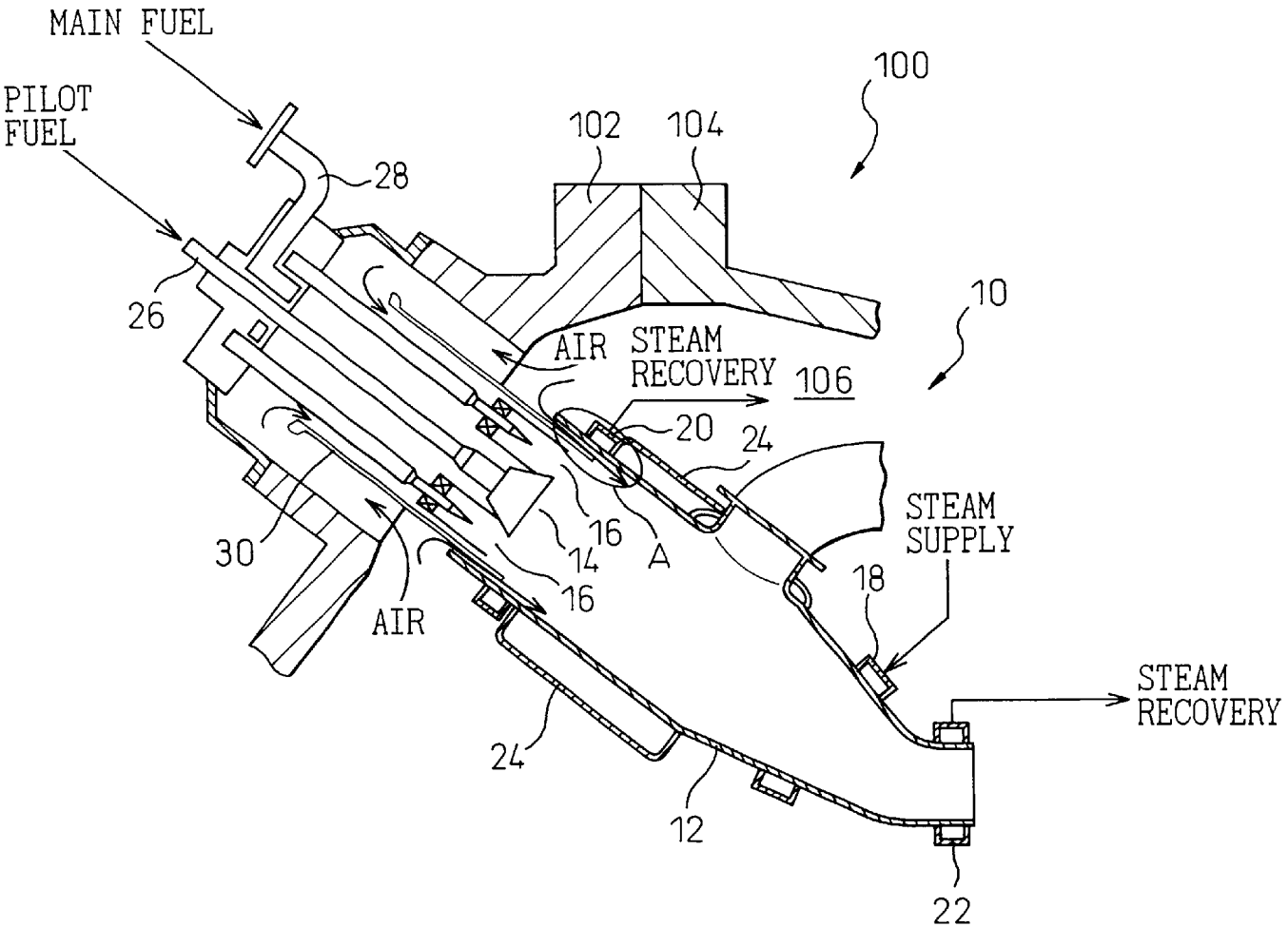
FIG. 1 is a sectional view of A gas turbine combustor according to a preferred embodiment of the present invention.

With reference to the drawings, a preferred embodiment of the present invention will be described below.

A gas turbine 100 according to the embodiment includes a compressor (not shown), an expander (not shown) connected to the compressor by a shaft, a casing 102 and 104 for enclosing the compressor and the expander, and a combustor 10 fixed to the casing 102 and 104. The air compressed by the compressor is supplied to the combustor 10 through a compressed air chamber 106 defined by the casing 102 and 104.

The combustor 10 has cylindrical a combustor tail tube 12 and an inner tube 30. A pilot nozzle 14 is provided at the center of the inner tube 30 around which a plurality of main nozzles 16 are disposed. A fuel, for example natural gas, is supplied as a pilot fuel to the pilot nozzle 14 through a pilot fuel supply conduit 26. The pilot nozzle 14 discharges the pilot fuel into the combustor tail tube 12 to form a diffusion flame. A fuel, for example natural gas, is supplied as a main fuel through a main fuel supply conduit 28 so that the main fuel is mixed with air, supplied from the compressed air chamber 106, in a volume upstream of the main nozzles 16. The main nozzles 16 discharge the fuel-air mixture into the inner tube 12 to form premixed flames.

Figure 2:
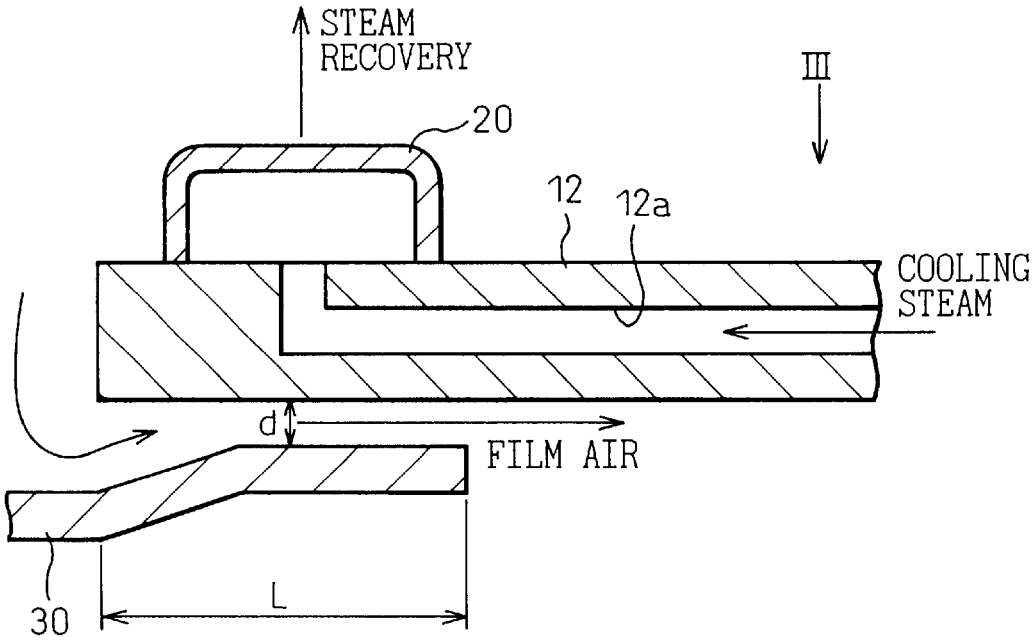
FIG. 2 is an enlarged section of a portion indicated by "A" in FIG. 1.

With reference to in particular FIG. 2, the inner tube 30 has an outer diameter smaller than the inner diameter of the combustor tail tube 12 so that a gap "d" is defined between the inner tube 30 and the combustor tail tube 12. The inner tube 30 is inserted into the combustor tail tube 12 by a predetermined length "L". This configuration allows the high pressure air in the compressed air chamber 106 to flow into the combustor tail tube 12 through the gap "d" as a film air along the inner surface of the combustor tail tube 12. When the film air flows along the inner surface of the combustor tail tube 12, it is mixed with the main fuel-air mixture or the premixed flames discharged through the main nozzles 16. Therefore, the fuel-air ratio of the premixed flames is reduced in the region adjacent the inner surface of the combustor tail tube 12 so that a rapid combustion is restrained in the region adjacent the inner surface of the combustor tail tube 12. This reduces oscillation energy to restrain the combustion-driven oscillation.

Figure 3:
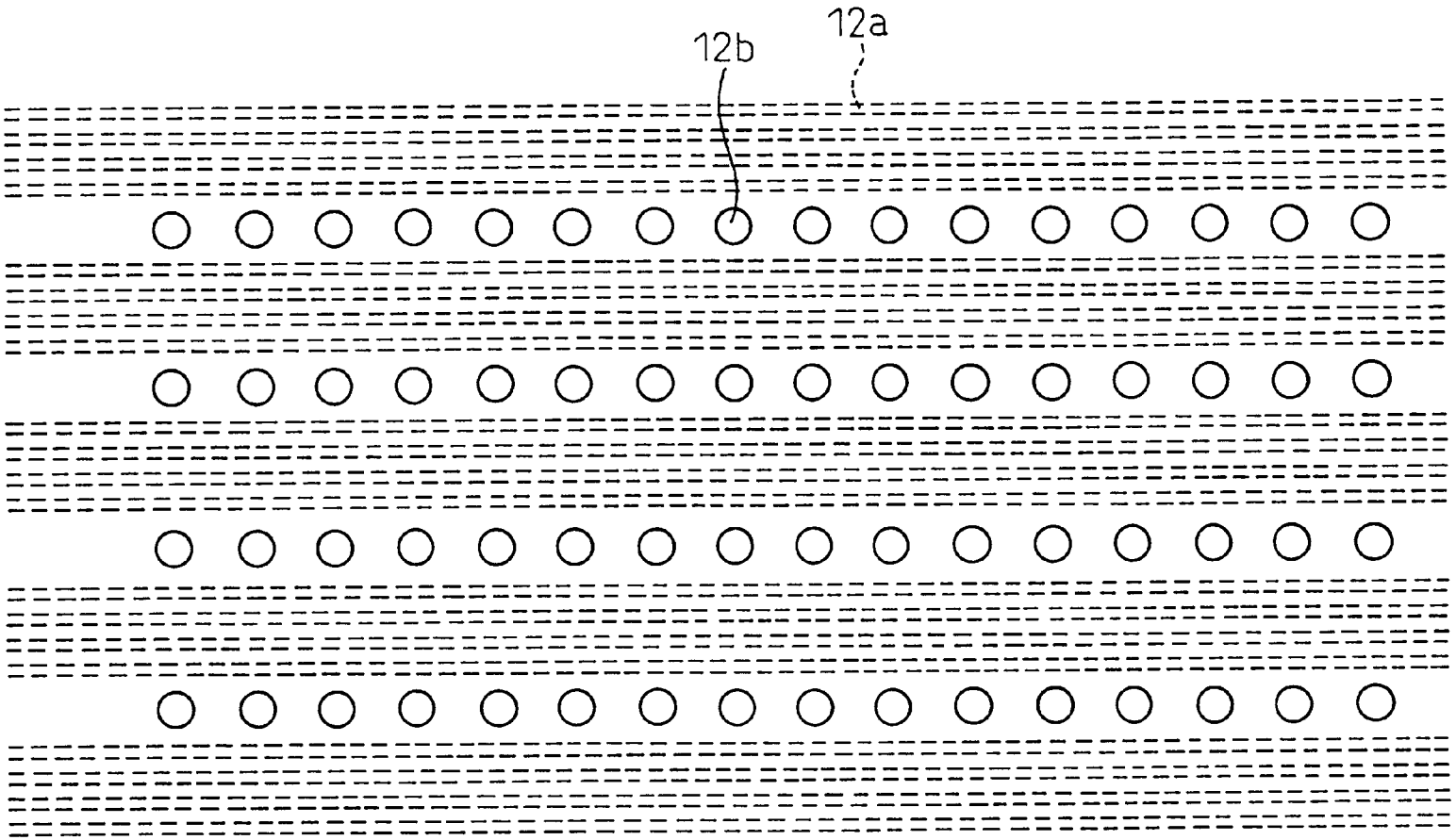
FIG. 3 is a partial side view of a combustor tail tube in the direction of III in FIG. 2, showing steam passages and a plurality of oscillation damping orifices.
Figure 4:
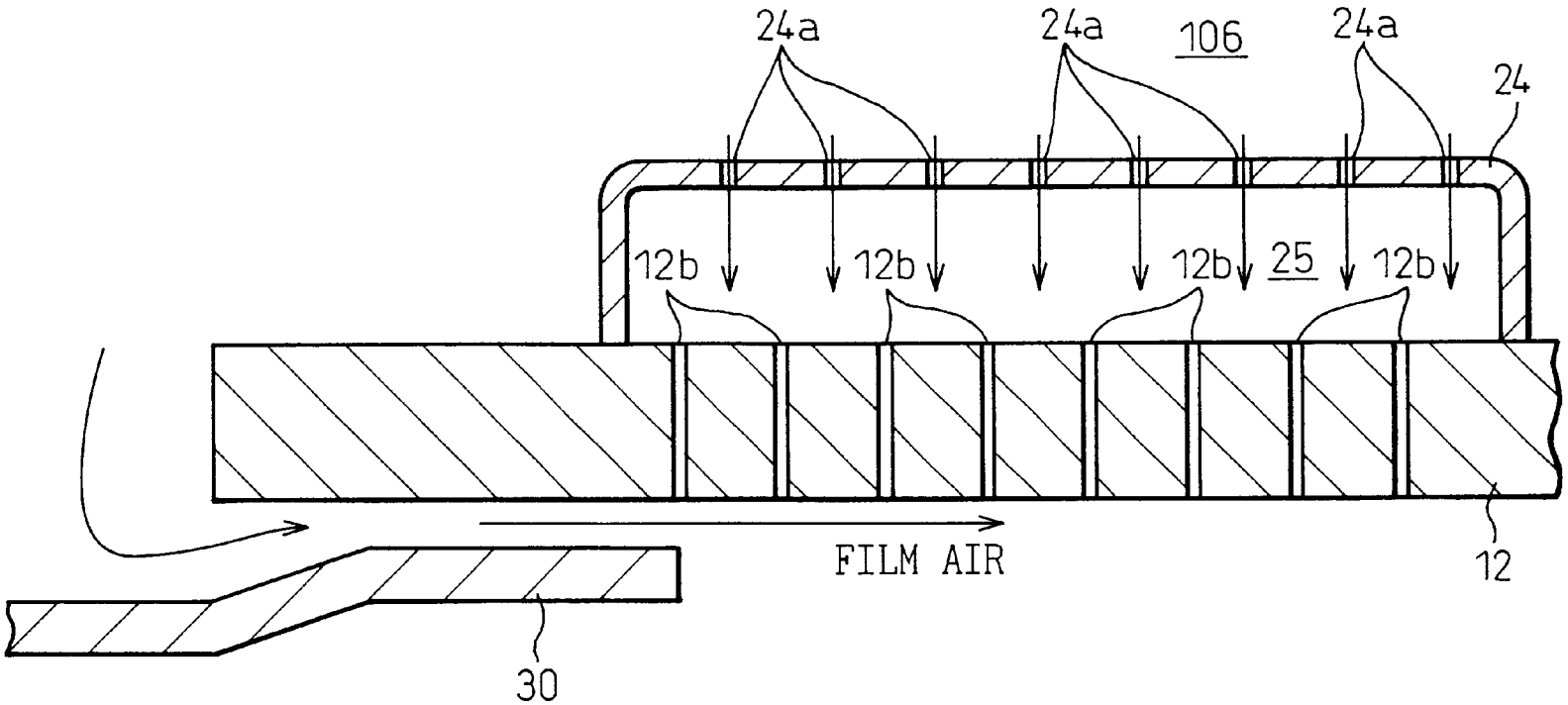
FIG. 4 is another section of the portion indicated by "A" in FIG. 1.

In this embodiment, the combustor tail tube 12 defines a plurality of axially extending steam passages 12*a* (shown in FIGS. 2 and 3) into which cooling steam is supplied through a steam header 18 from an external steam source and may be, for example steam extracted from an intermediate pressure turbine to cool the casing. The steam which has passed through the steam passage 12*a* to cool the combustor tail tube 12 is recovered by a steam recovery apparatus, for example a low pressure turbine.

An acoustic liner 24 is preferably attached to the combustor tail tube 12 so that the acoustic liner 24 encloses the outer surface adjacent the rear end of the combustor tail tube 12 to define an acoustic buffer chamber 25 between the acoustic liner 24 and the outer surface of the combustor tail tube 12. A plurality of orifices 12*b*, which radially extend through the wall of the combustor tail tube 12 to fluidly communicate the internal volume of the combustor tail tube 12 with the acoustic buffer chamber 25, are defined as oscillation damping orifices. With reference to in particular FIG. 3, in this embodiment, the orifices 12*b* are disposed in lines between respective sets of four steam passages 12*a*. When a combustion-driven oscillation, in particular oscillation within a plane perpendicular to the axis of the combustor tail tube 12 or peripheral and/or radial oscillation is generated in a region adjacent the proximal end portion of the combustor tail tube 12, the orifices 12*b* allow the combustor 10 to restrain the combustion-driven oscillation by reducing the pressure of the fuel-air mixture moving through the orifices 12*b* to reduce the oscillation energy.

The preferred embodiment of the present invention has been described. The invention, however, is not limited to the embodiment and can be varied and modified within the scope of the invention.

For example, a plurality of orifices 24*a* can be provided as air cooling orifices in the acoustic liner 24 for introducing the air from the compressed air chamber 106 into the acoustic buffer chamber 25. The provision of the air cooling orifices 24*a* allows the wall portions between the adjoining orifices 12*b* of the combustor tail tube 12 to be cooled by the air through the air cooling orifices 24*a*. The air cooling orifices 24*a* are preferably disposed in lines aligned over the corresponding lines of the orifices 12*b* and axially offset relative to the orifices 12*b* so that the air cooling orifices 24*a* are axially positioned intermediately between the adjoining orifices 12*b*. The above-described disposition of the air cooling orifices 24*a* allows the air to flow into the acoustic buffer 25 through the air cooling orifices 24*a* as impingements jet relative to the wall of the combustor tail tube 12 and to effectively cool the wall portions between the adjoining orifices 12*b* of the combustor tail tube 12.

Figure 5:
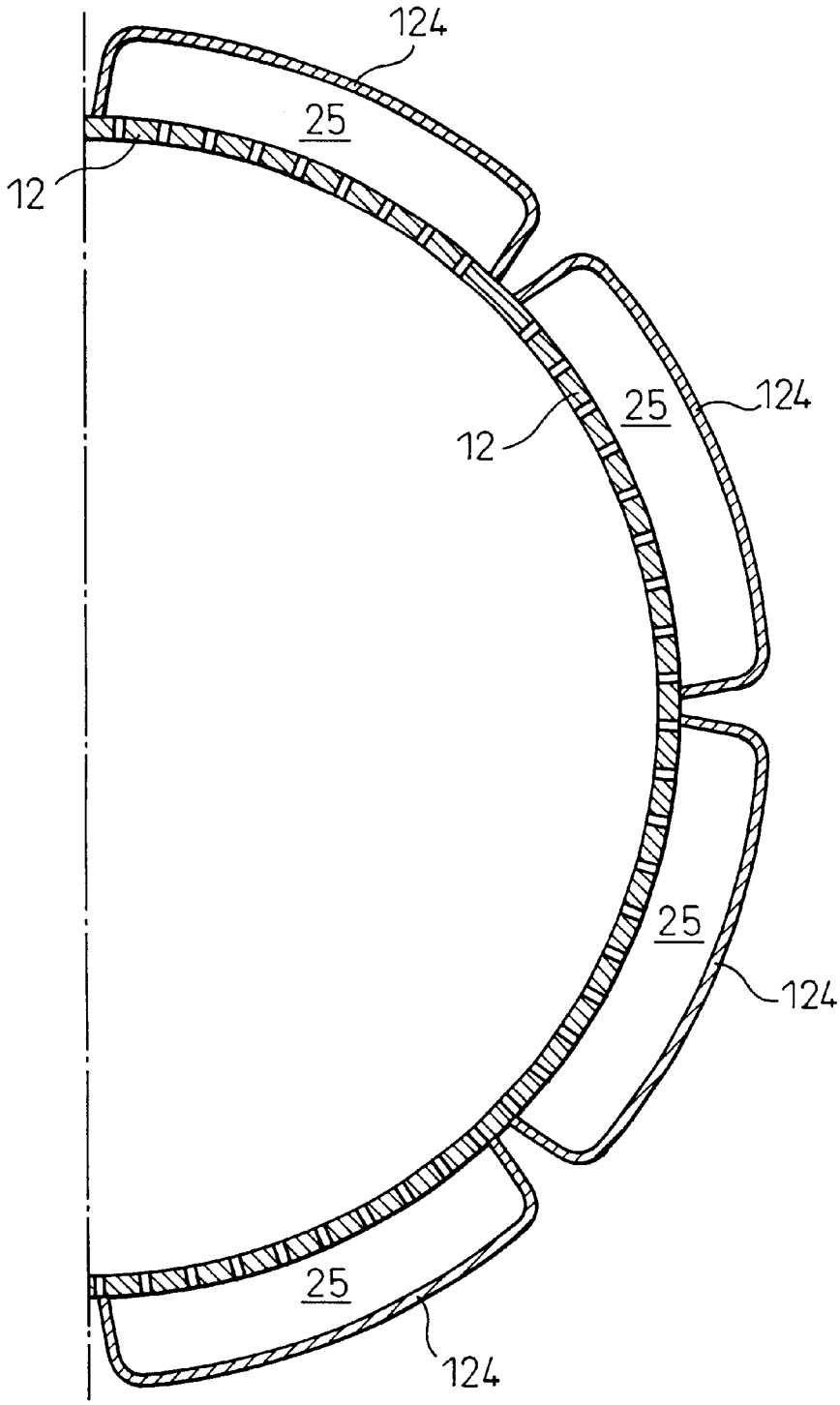
FIG. 5 is a partial section of the combustor tail tube along a plane perpendicular to the axis of the gas turbine combustor, showing liner segments forming an acoustic liner of the invention.

Further, the acoustic liner 24 is not required to comprise an integral single body enclosing the proximal end portion of the combustor tail tube 12. The acoustic liner 24 can comprise a plurality of liner segments 124 disposed around the combustor tail tube 12, as shown in FIG. 5. The configuration of the acoustic liner 24 composed of the liner segments 124 allows the thermal stress generated in the acoustic liner 24 to be reduce by the temperature difference between the acoustic liner 24 and the combustor tail tube 12.

Figure 6A:
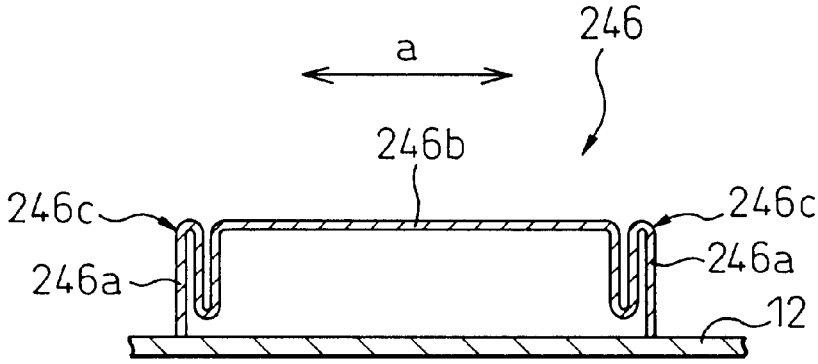
FIG. 6A is a partial section of the combustor tail tube along a plane perpendicular to the axis of the gas turbine combustor, showing liner segments according to another embodiment.

Further, a bellows portion, for reducing thermal stress, may be provided in the liner segments. With reference to FIG. 6A, a liner segment 246 has lateral bellows portions 246*c* disposed between side wall portions 246*a*, attached to the side wall of the combustor tail tube 12, and peripheral wall portion 246*b*, substantially parallel to the side wall of the combustor tail tube 12. The lateral bellows portions 246*c* allows the liner segment 246 to deform, between the side wall portions 246*a* and the peripheral wall portion 246*b*, mainly in the direction shown by arrow "a", parallel to the side wall of the combustor tail tube 12.

Figure 6B:
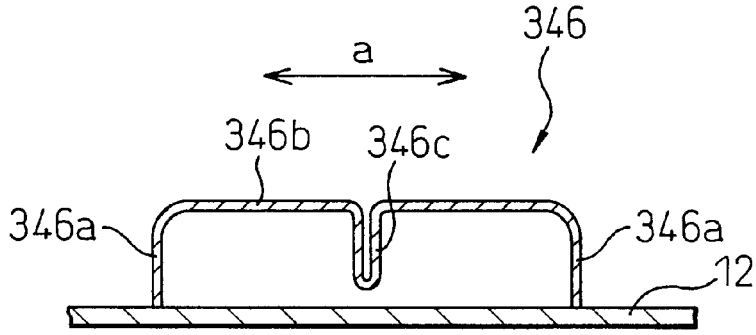
FIG. 6B is a partial section similar to FIG. 6A, showing liner segments according to another embodiment.

In another embodiment shown in FIG. 6B, liner segment 346 has a lateral bellows portion 346*c*, provided in the peripheral wall portion 346*b* other than between the side wall portions 346*a*, attached to the side wall of the combustor tail tube 12, and the peripheral wall portion 346*b*, substantially parallel to the side wall of the combustor tail tube 12, as in the embodiment of FIG. 6A. The lateral bellows portion 346*c* allows the liner segment 346 to deform in the direction of arrow "a" and parallel to the side wall of the combustor tail tube 12.

Figure 6C:
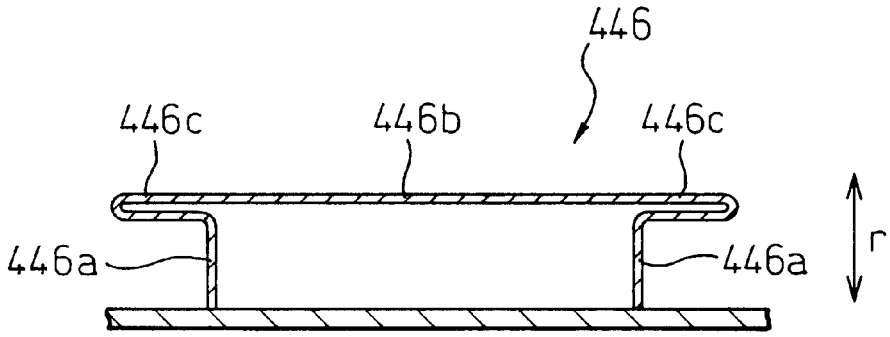
FIG. 6C is a partial section similar to FIGS. 6A and 6B, showing liner segments according to another embodiment.

In another embodiment shown in FIG. 6C, liner segment 446 has perpendicular bellows portions 446*c* disposed between side wall portions 446*a*, attached to the side wall of the combustor tail tube 12, and the peripheral wall portion 446*b*, substantially parallel to the side wall of the combustor tail tube 12. The perpendicular bellows portions 446*c* allow the liner segment 446 to deform in the radial direction of arrow "r" perpendicular to the side wall of the combustor tail tube 12.

Figure 7A:
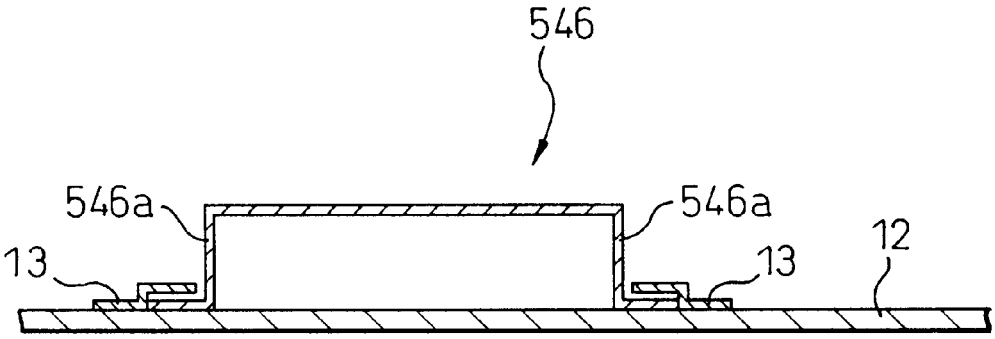
FIG. 7A is a partial section of the combustor tail tube along a plane including the axis of the gas turbine combustor, showing liner segments according to another embodiment.
Figure 7B:
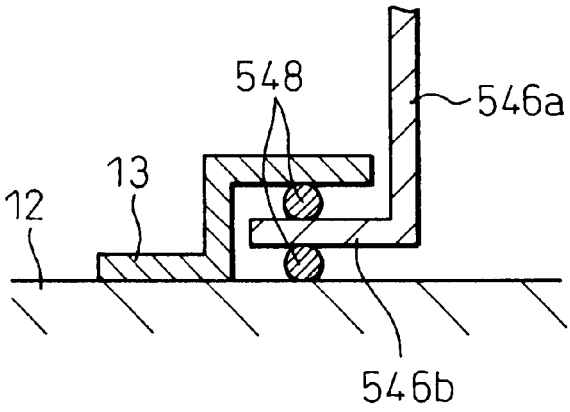
FIG. 7B is an enlarged section of the liner segment shown in FIG. 7A.

Further, in an embodiment shown in FIGS. 7A and 7B, the liner segment 546 has side walls 546*a* terminated by outwardly extending engagement portions 546*b*. Catches 13, which have Z-shaped section, are attached to the outer surface of the side wall of the combustor tail tube 12. Engaging the engagement portions 546*b* with the catches 13 allows the liner segments 546 to be attached to, but movable relative to, the combustor tail tube 12. By movably attaching the liner segment to the combustor tail tube 12, the thermal stress due to the temperature difference therebetween can be reduced or prevented. Further, sealing members 548 may be disposed between the engagement portions 546*b* and the catches 13 or combustor tail tube 12. The sealing members 548 may comprise a thermally resistive O-ring, a thermally resistive C-ring, a thermally resistive E-ring, a thermally resistive wire mesh, or a thermally resistive brush seal.

It will also be understood by those skilled in the art that the forgoing description describes preferred embodiments of the disclosed device and that various changes and modifications may be made without departing from the spirit and scope of the invention.

We claim:

1. A gas turbine combustor comprising:

a side wall, for defining a combustion volume, having upstream and downstream ends;

a pilot nozzle, disposed adjacent the upstream end of the side wall, for discharging a pilot fuel to form diffusion flame in the combustion volume;

a plurality of main nozzles, provided around the pilot nozzles, for discharging a fuel-air mixture to form premixed flames in the combustion volume; and means for supplying film air into the combustion volume substantially parallel to along the inner surface of the side wall to reduce the fuel-air ratio in a region adjacent the inner surface of the side wall and to restrain a combustion-driven oscillation in the combustion volume.

2. A gas turbine combustor, according to claim 1, wherein the side wall includes a plurality of oscillation damping orifices which are defined in a region downstream of the main nozzles and extend radially through the side wall.

3. A gas turbine combustor, according to claim 2, further comprising an acoustic liner attached to the outer surface of the side wall in a region where the oscillation damping orifices are defined.

4. A gas turbine combustor, according to claim 3, wherein the acoustic liner comprises a plurality of liner segments attached to the outer surface of the side wall.

5. A gas turbine combustor, according to claim 4, wherein the liner segments include bellows portions for reducing thermal stress due to the temperature difference between the side wall of the gas turbine combustor and the respective liner segments.

6. A gas turbine combustor, according to claim 5 further comprising catches attached to the outer surface of the side wall; and The liner segments including engagement portions for engaging the catches whereby the engagement of the engaging portions with the catches allows the liner segments to be attached to the outer surface of the side wall.

7. A gas turbine combustor, according to claim 6 further comprising sealing members provided between the engaging portions and the catches or the side wall.

8. A gas turbine combustor, according to claim 1, wherein the side wall includes a plurality of steam passages for allowing cooling steam to flow therethrough; and the oscillation damping orifices being disposed in lines between the steam passages.

9. A gas turbine combustor, according to claim 8, wherein the acoustic liner includes a peripheral wall facing the side wall of the combustor and a plurality of air cooling orifices defined in the peripheral wall disposed in lines aligned over the lines of the oscillation damping orifices.

10. A gas combustor, according to claim 9, wherein the air cooling orifices are disposed to face the wall portions between the adjoining oscillation damping orifices.

* * * * *